United States Patent [19]

Flatau

[11] 3,954,057

[45] May 4, 1976

[54] RADIO CONTROLLED WING ROTOR BOMBLET

[75] Inventor: Abraham Flatau, Edgewood, Md.

[73] Assignee: The United States of America as represented by the Secretary of the Army, Washington, D.C.

[22] Filed: July 28, 1966

[21] Appl. No.: 568,682

[52] U.S. Cl. ..... 102/3; 102/7.2

[51] Int. Cl.[2] ..... F42B 25/24

[58] Field of Search ..... 102/2–4, 102/7.2

*Primary Examiner*—Charles T. Jordan

*Attorney, Agent, or Firm*—Nathan Edelberg; Robert P. Gibson; Kenneth P. Van Wyck

[57] ABSTRACT

The invention is directed to controlling the flight of an autorotating wing rotor comprising an elongated wing rotor, actuating means remotely controlled, plates coaxially secured to each end of the said rotor, flight control means, said actuating means driving said flight control means axial movement along means mounted adjacent each end of said rotor and thereby effecting the trajectory of the autorotating wing rotor.

10 Claims, 8 Drawing Figures

INVENTOR.
Abraham Flatau

BY: Harry M. Saragovitz,
Edward J. Kelly,
Herbert Berl &
Benjamin G. Colley
ATTORNEYS.

RADIO CONTROLLED WING ROTOR BOMBLET

This invention relates to a radio controlled wing rotor bomblet which is designed to be dropped or launched from an aircraft.

The main object of this invention is to provide a type of ordnance which utilizes the aerodynamic glide angle potential of certain geometric shapings and the resultant flight stability by incorporating devices which allow the trajectory to be controlled so as to obtain a greater degree of precision or accuracy in hitting a target.

An additional object of this invention is to provide a munition which achieves a glide angle from about 45° to about 73° from the vertical, depending on the particular dimensional ratios selected.

A further object of this invention is to provide a munition which in addition to gliding to its target without any power requirements (due to its shaping, autorotation, and the resultant aerodynamic forces) can be steered to the exact target by the means of a radio controlled device.

A still further object of my invention is to provide an autorotating or wing rotor bomblet with glide trajectory control means on either end of the bomblet which are independently controlled either by the operator in the delivery aircraft, which of necessity must remain or hover in an area outside of the target and beyond range of ground fire, or to be turned over to another airborne controller or a forward ground observer and controller.

It is known that attempts at controlling autorotating bodies of this type have been made by an internal shift in the center of gravity. It is also known that movement of portions of the end plates has been designed as a means of attempting to control the glide path of the wing rotor bomblets. However, these prior devices are objectionable in that the former concept required a relatively large mass or masses, and this reduced the available payload capacity. Furthermore, the large mass or masses increased the overall weight without a compensatory gain in payload efficiency. The latter concept disturbed the air flow pattern and the lifting force resulting from autorotation.

I have discovered that it is much more efficient aerodynamically towards maintaining stability and control with the requisite maximum glide angle to provide the autorotating body with control devices outside of the end plates by minimizing the disturbance of the airflow pattern between the end plates which produces the autorotation, lifting force, and stability. In addition, a larger payload capacity is available by not utilizing shifting masses as a means of control.

Other objects and advantages of my invention will become apparent as the following description is read in connection with the accompanying drawing in which.

Figure 1:
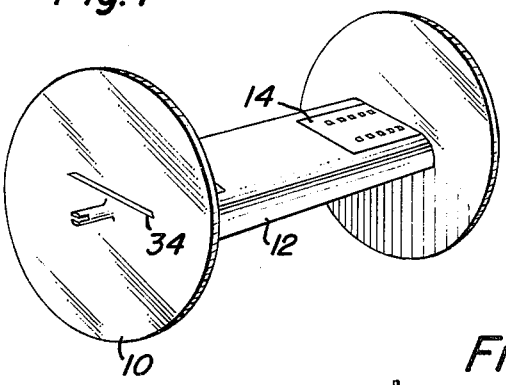
FIG. 1 is an isometric view of the high glide angle radio controlled wing rotor bomblet.
Figure 2:
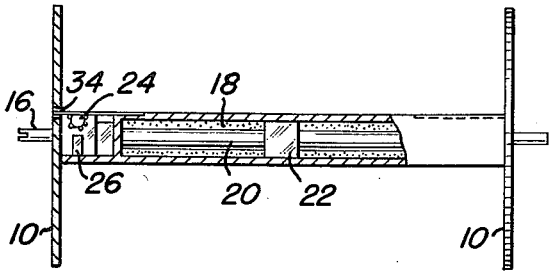
FIG. 2 is a cross sectional view taken on the center line of FIG. 1 showing an internal arrangement of the operating parts.
Figure 8:
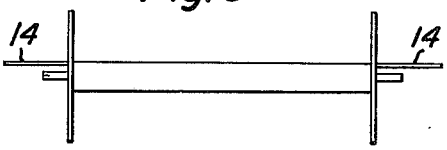
FIG. 8 is a side view of the device with the flight control means fully extended.
Figure 3:
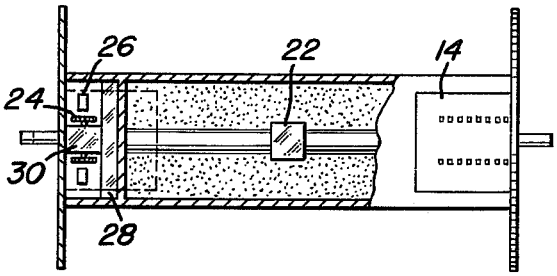
FIG. 3 is a partial cross sectional view of FIG. 1 showing a horizontal cross sectional view.
Figure 4:
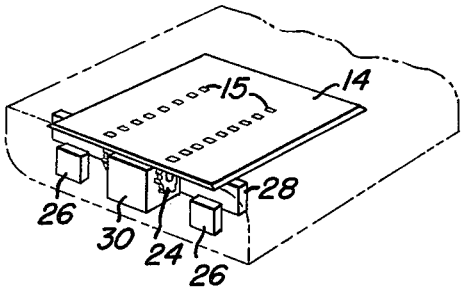
FIG. 4 is an enlarged isometric view showing the arrangement of parts for the operation of the flight control means.
Figure 6:
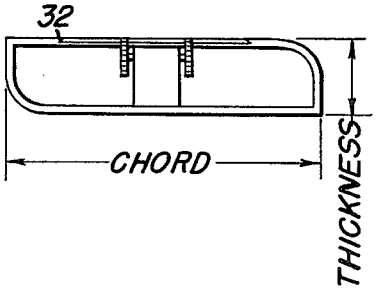
FIG. 6 is a cross sectional view of FIG. 1 showing the details of the flight control means in its slot.

Referring to the drawings, 10 designates the end plates which are coaxially secured to each end of the wing rotor 12. The flight control means 14 is shown in FIG. 1 in a fully retracted position. However, upon actuation of the servo motors 30, the substantially square flight control plates 14 can be moved axially of said wing rotor 12 to any position up to and including the fully extended position shown in FIG. 8. The flight control plates slide back and forth in a tapered groove 32 as shown in FIG. 6 and extend through the end plates 10 by means of slot 34 therein. Depending on the transmitter channel selected, either plate may be extended independently or both plates extended simultaneously.

The bomblet contains a payload 18 which can be of any desired component such as chemical warfare agents, high explosives, and the like. Associated with the payload is a central burster 20 and a standard rotary arming fuse 22. The fuse 22 is of a conventional type which will arm itself upon rotation in the air and upon impact with the ground will touch off the central burster 20, thereby exploding the bomblet with dispersion of its contents over the desired target area. It is to be distinctly understood that the bomblet is rotationally balanced to the extent that the flight control plates and their movement are not a factor in causing any instability of the autorotor during flight. The flight control plates 14 are relatively light compared to the weight of the bomblet. Therefore, during their axial movement, the plates 14 contribute a very minute shift in the center of gravity and little if no change in the trajectory due to the shift of the mass of the plates themselves. The aerodynamic forces and moments acting on the plates 14 are thus almost completely responsible for the change in the trajectory. Likewise, the internal components such as the payload 18, central burster 20, and fuse 22 are situated so that they do not impart any instability to the bomblet.

In addition to the above components, the bomblet also contains batteries 26 which are nickel-cadmium batteries, the servo motor 30, and the radio receiver 28. As before, all these components are strategically located within the thickness of the bomblet so that their weight is evenly distributed. The servo motor 30 has on either side of it a pinion ear 24 which meshes with a series of holes 15 in the flight control plates 14. This produces a rack and pinion gear effect which will drive the flight control plates in response to signals originating from the radio transmitter located in the hovering aircraft. It is also possible to provide a rack gear which will be driven by the pinion gear 24 to produce the desired effect. The servo motor 30 has an automatic stop device on each end of its run, clockwise and counterclockwise so that the control plates 14 do not drop out. The electrical components are standard radio control components which are commercially available and which provide for a proportional response of the radio receiver and servo to the commands of the radio transmitter. A minimum of three channels are required. Further reduction in the component volume and weight may be achieved by using microminiaturization. Thus, the payload can be further increased.

Figure 7:
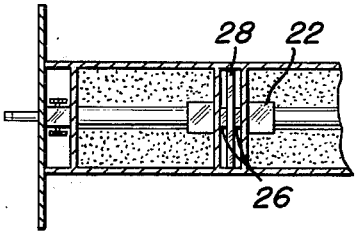
FIG. 7 is a partial horizontal cross sectional view of the modification shown in FIG. 5.
Figure 5:
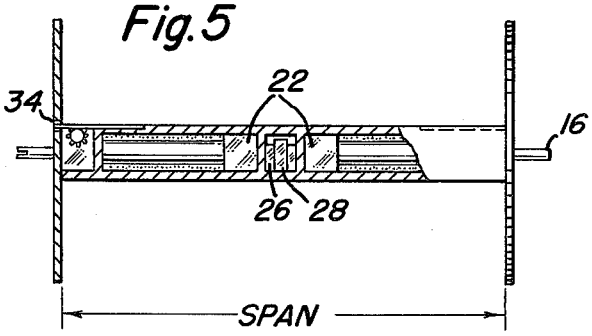
FIG. 5 is an alternative vertical cross sectional view of a modified design of this invention.

FIGS. 5 and 7 show a modification of this invention in which the radio receiver 28 is located in the center of the bomblet with the batteries 24 adjacent it, and in which the payload section of the bomblet has two compartments with two fuses 22. The advantage of this modification being that if one fuse 22 fails to function, the other fuse will function upon impact.

The length of the bomblet is substantially the distance between the end plates 10, and can be referred to as the span. This length or span is limited solely by the dimensions of the hatch of the aircraft which is to deliver the bomblets and the dispensing mechanism. I have found that the length or span should be within the range of 3 to 7 times the chord, which is the width of the wing rotor. In addition, I have discovered that the thickness of said wing rotor can vary from one-fourth to one-half of said chord. These ranges have been found to give the optimum glide angle from the vertical which is set forth above.

Therefore, with my bomblet, it is possible for the operator to remain in the delivery aircraft in the general vicinity of the target and steer the bomblet to the desired target and at the same time be outside the range of effective hostile firepower. It is also possible, under the appropriate circumstances, to allow another operator in a second aircraft to assume control of my bomblets. This would occur for example if the delivery aircraft were to be shot down. It is also possible to allow a forward ground observer to direct my bomblets to the desired target. My bomblets have the basic property without the addition of the control means of remaining in the approximate direction from which they are launched because of the planar directional stabilization effect of the end plates 10, together with the gyroscopic and aerodynamic stability resulting from the rotation of the body. Therefore, they can be aimed in the general direction of the target by launching from the delivery aircraft and then altered in course by the flight control plates to hit the exact desired target at will within the envelope of the maximum range of the bomblets based on their optimum glide angle.

Obviously, the bomblets can be steered to the left or to the right by my invention. By extending both plates simultaneously, it is possible to steepen the glide path at will to hit targets at shorter ranges, due to the sudden increase in drag.

Although these bomblets may be readily launched manually from the aircraft, a simple launch mechanism consisting of two parallel racks which will allow the bomblet to initiate their flight in a generally horizontal position can be readily made. For this purpose, I have provided spindles 16 on which a mechanical type launching mechanism will be operable.

It is obvious that to increase the efficiency of the ordnance capability from the rate of fire viewpoint that a simple clip design may be incorporated to positively feed the autorotor into the final position for launching.

It will, of course, be understood that various details of construction may be varied through a wide range without departing from the principle of this invention. Therefore, I do not wish to be limited by the details shown and described, and I only wish to be limited by the claims as set forth below.

I claim:

1. A self-dispersing radio controlled wing rotor bomblet comprising in combination, A. elongate wing rotor means of substantially rectangular cross section, 1. flight control means adapted for axial movement relative to said wing means mounted adjacent each end thereof,
2. radio controlled motor means mounted within said wing means and operatively connected to said control means,
3. electric power means mounted within said wing means adjacent to and operatively connected to said motor means, B. end plate means coaxially secured to each end of said wing means, 1. said end plate means having slot means adjacent the center thereof for receiving said control means when they are moved axially by said motor means.

2. A self-dispersing radio controlled wing rotor bomblet comprising in combination, A. an elongate wing rotor of substantially rectangular cross section having a span, chord, and thickness of substantial proportions, 1. a pair of flight control plates adapted for axial movement relative to said wing rotor mounted adjacent each end thereof,
2. radio controlled servo motors mounted within said wing rotor operatively connected to said plates,
3. battery means mounted within said wing rotor operatively connected to said motors, B. a pair of end plates of a diameter substantially larger than the chord of said wing rotor coaxially secured thereto, 1. said end plates having a slot adjacent the center thereof for receiving said control plates when they are moved axially by said servo motors.

3. A bomblet as set forth in claim 2 in which said flight control plates are substantially square and are substantially equal to the width of said chord.

4. A bomblet as set forth in claim 3 in which each of said flight control plates are mounted for axial movement in a tapered slot in said elongate wing.

5. A bomblet as set forth in claim 2 in which each of said servo motors has a pair of pinion gears which mesh with rack gearing on said flight control plates.

6. A bomblet as set forth in claim 5 in which said flight control plates have a parallel series of holes which mesh with said pinion gears to form a rack and pinion gear set.

7. A self-dispersing radio controlled wing rotor bomblet comprising in combination, A. an elongate wing rotor of substantially rectangular cross section having a span, chord, and thickness of substantial proportions, 1. a pair of flight control plates adapted for axial movement relative to said wing rotor mounted adjacent each end thereof,
2. radio controlled servo motors mounted within said wing rotor operatively connected to said plates,
3. battery means mounted within said wing rotor operatively connected to said motors, B. a pair of end plates of a diameter in the range from one to two times the chord of said wing rotor coaxially secured thereto, 1. said end plates having a slot adjacent the center thereof for receiving said control plates when they are moved axially by said servo motors.

8. A bomblet as set forth in claim 7 in which said flight control plates are substantially square and substantially equal to the width of said chord.

9. A bomblet as set forth in claim 8 in which each of said flight control plates are mounted for axial movement in a tapered slot in said elongate wing.

10. A bomblet as set forth in claim 7 in which each of the said servo motors have a pair of pinion gears which mesh with rack gearing on said flight control plates.

* * * * *